US006267277B1

(12) United States Patent
Taylor

(10) Patent No.: US 6,267,277 B1
(45) Date of Patent: Jul. 31, 2001

(54) MAGNETIC TOOL AND EQUIPMENT HOLDER

(76) Inventor: Adam M. Taylor, 17463 Chadsford Ave., Baton Rouge, LA (US) 70817

( * ) Notice: Subject to any disclaimer, the term of this patent is extended or adjusted under 35 U.S.C. 154(b) by 0 days.

(21) Appl. No.: 09/578,571

(22) Filed: May 25, 2000

(51) Int. Cl.[7] ..... A45F 5/00

(52) U.S. Cl. ..... 224/183; 224/610; 224/615; 206/350; 206/373

(58) Field of Search ..... 224/183, 607, 224/610, 615, 616, 617, 232, 234; 206/350, 372, 373, 376, 377

(56) References Cited

U.S. PATENT DOCUMENTS

| | | | | |
|---|---|---|---|---|
| D. 280,465 | * | 9/1985 | Baum | D3/33 |
| 2,540,340 | * | 2/1951 | Linblade | 43/57.1 |
| 4,482,049 | | 11/1984 | Kot, II . | |
| 4,826,059 | | 5/1989 | Bosch et al. . | |
| 4,932,576 | | 6/1990 | Ashley . | |
| 5,024,361 | | 6/1991 | Flowers . | |
| 5,213,240 | | 5/1993 | Dietz et al. . | |
| 5,274,937 | | 1/1994 | Birnbaum . | |
| 5,341,975 | | 8/1994 | Marinescu . | |
| 5,639,003 | | 6/1997 | Utzinger, III . | |
| 5,660,276 | | 8/1997 | Winnard . | |
| 5,725,096 | | 3/1998 | Winnard . | |
| 5,743,394 | | 4/1998 | Martin . | |
| 5,758,807 | | 6/1998 | Wright . | |
| 5,826,762 | * | 10/1998 | Dellinger | 224/270 |
| 5,971,101 | * | 10/1999 | Taggart | 182/129 |
| 6,070,729 | * | 6/2000 | Barnes | 206/581 |

* cited by examiner

*Primary Examiner*—Stephen K. Cronin
(74) *Attorney, Agent, or Firm*—David L. Ray

(57) ABSTRACT

In accordance with the first embodiment of the invention there is provided a portable, flexible tool holder having a generally rectangular flexible body, the body having an inner surface and an outer surface and an upper edge, a lower edge and two side edges, the outer surface having a plurality of magnets connected thereto, the inner surface having a plurality of pockets an loops thereon for holding tools and equipment, either of the side edges being foldable toward the other of the side edges to enclose the inner surface of the body inside the outer surface of the body to tightly hold tools and equipment within the tool holder, and the upper edge having receivers for attaching a carrying device to the tool holder.

In accordance with a second embodiment of the invention there is provided a portable tool holder having a generally rectangular body, the body having an inner surface and an outer surface, the outer surface having a plurality of magnets connected thereto, the inner surface having a pocket for holding welding rods and a strap assembly located beneath on the lower end of the pocket for holding tools and equipment, and the upper edge having a receiver for attaching a carrying device to the tool holder.

5 Claims, 5 Drawing Sheets

MAGNETIC TOOL AND EQUIPMENT HOLDER

BACKGROUND OF THE INVENTION

1. Field of the Invention

The invention relates to portable tool holders. In particular, the invention relates to flexible, portable tool holders and tool bags having magnets therein.

2. Description of the Related Art

Boiler makers in particular, and other workers working around metal structures in general, including millwrights, electricians, welders and the like, commonly carry their tools and equipment in buckets. Such tools and equipment may include wrenches, pliers, screw drivers, hammers, chipping hammers, measuring taps, levels, squares, welding rods and the like. The buckets are carried to the work location and placed beside the worker for easy access.

When the worker is working on a tall or elevated structure, the bucket of tools and equipment must be carried by the worker up a stairway or ladder, or the bucket may be attached to a rope and pulled up by the rope. Since the bucket must be grasped by one of the worker's two hands, climbing stairways or ladders with a bucket of tools and other equipment is difficult and dangerous. In addition, the bucket of tools may be accidently kicked over or turned over and tools spilled therefrom.

The surface on which the bucket of tools is placed, such as a scaffold, may be small and have openings therearound through which tools may fall. In some work locations there may be no surface on which to place a worker's tool bucket. Tools in buckets being used above ground level may fall downwards onto other workers and cause serious injury or death.

Magnetic tool holders are known in the art. Exemplary of the Patents of the related art are the following U.S. Pat. Nos. 5,758,807; 5,743,394; 5,725,096; 5,660,276; 5,639,003; 5,341,975; 5,274,937; 5,213,240; 5,024,361; 4,932,576; 4,826,059; and 4,482,049.

SUMMARY OF THE INVENTION

It is an object of the invention to provide a portable, flexible tool holder which may be attached to a metal surface by magnets.

It is another object of the invention to provide a portable, flexible tool holder having side edges which may be rolled together to tightly enclose tools therein and prevent tools from falling therefrom even when the tool holder is inverted.

It is an additional object of the invention to provide a portable, flexible tool holder having side edges which may be rolled together to tightly enclose tools therein and secured with a strap which may be fitted over the user's shoulder to carry the tool holder.

In accordance with the first embodiment of the invention there is provided a portable, flexible tool holder having a generally rectangular flexible body, the body having an inner surface and an outer surface and an upper edge, a lower edge and two side edges, the outer surface having a plurality of magnets connected thereto, the inner surface having a plurality of pockets an loops thereon for holding tools and equipment, either of the side edges being foldable toward the other of the side edges to enclose the inner surface of the body inside the outer surface of the body to tightly hold tools and equipment within the tool holder, and the upper edge having receivers for attaching a carrying device to the tool holder.

In accordance with a second embodiment of the invention there is provided a portable, flexible, tool holder having a generally rectangular body, the body having an inner surface and an outer surface, the outer surface having a plurality of magnets connected thereto, the inner surface having a pocket for holding welding rods and a strap assembly located beneath on the lower end of the pocket for holding tools and equipment, and the tipper edge having a receiver for attaching a carrying device to the tool holder.

The tool holders of both embodiments of the invention have the advantage of being capable of supporting and connecting tools and equipment to a metal surface adjacent to the user.

The tool holder of the first embodiment of the invention has the additional advantage of being foldable about the tools held by the tool holder to prevent tools from falling from the tool holder when the tool holder is inverted or dropped.

DESCRIPTION OF THE PREFERRED EMBODIMENTS

Figure 1:
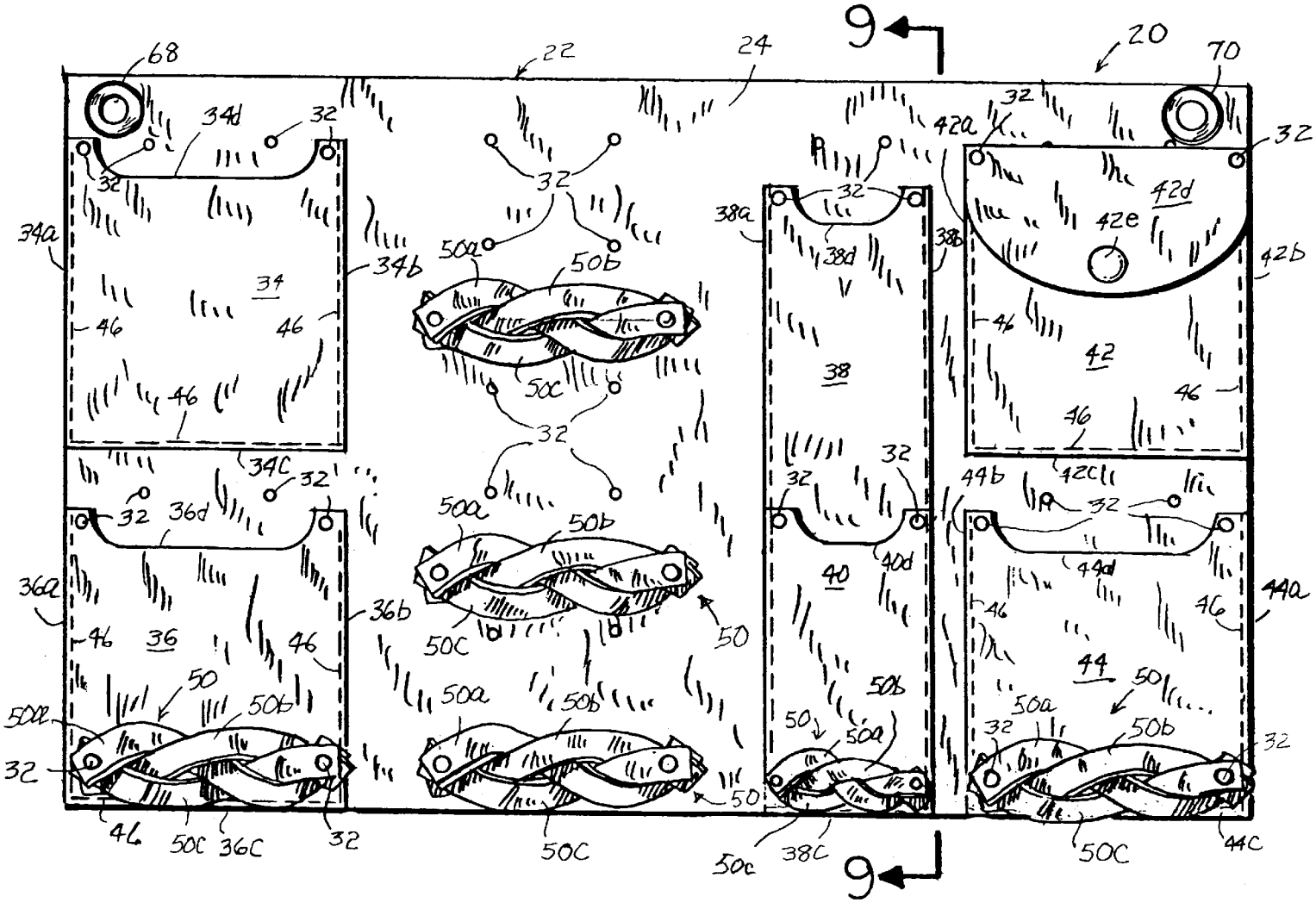
FIG. 1 is a front elevational view of the inner surface of the first embodiment of the invention.

Referring now to the drawings, and in particular to FIGS. 1, 2, and 5–11, the tool holder of the first embodiment of the invention is generally indicated by the numeral 20. Tool holder 20 has a main body generally indicated by the numeral 22. Preferably main body 22 is generally rectangular in shape. Main body 22 has an inner surface 24 and an outer surface 26. Preferably, main body 22 is made from a flexible leather such as cow hide, although other flexible materials such as heavy woven fabrics and the like could be used if desired.

Figure 2:
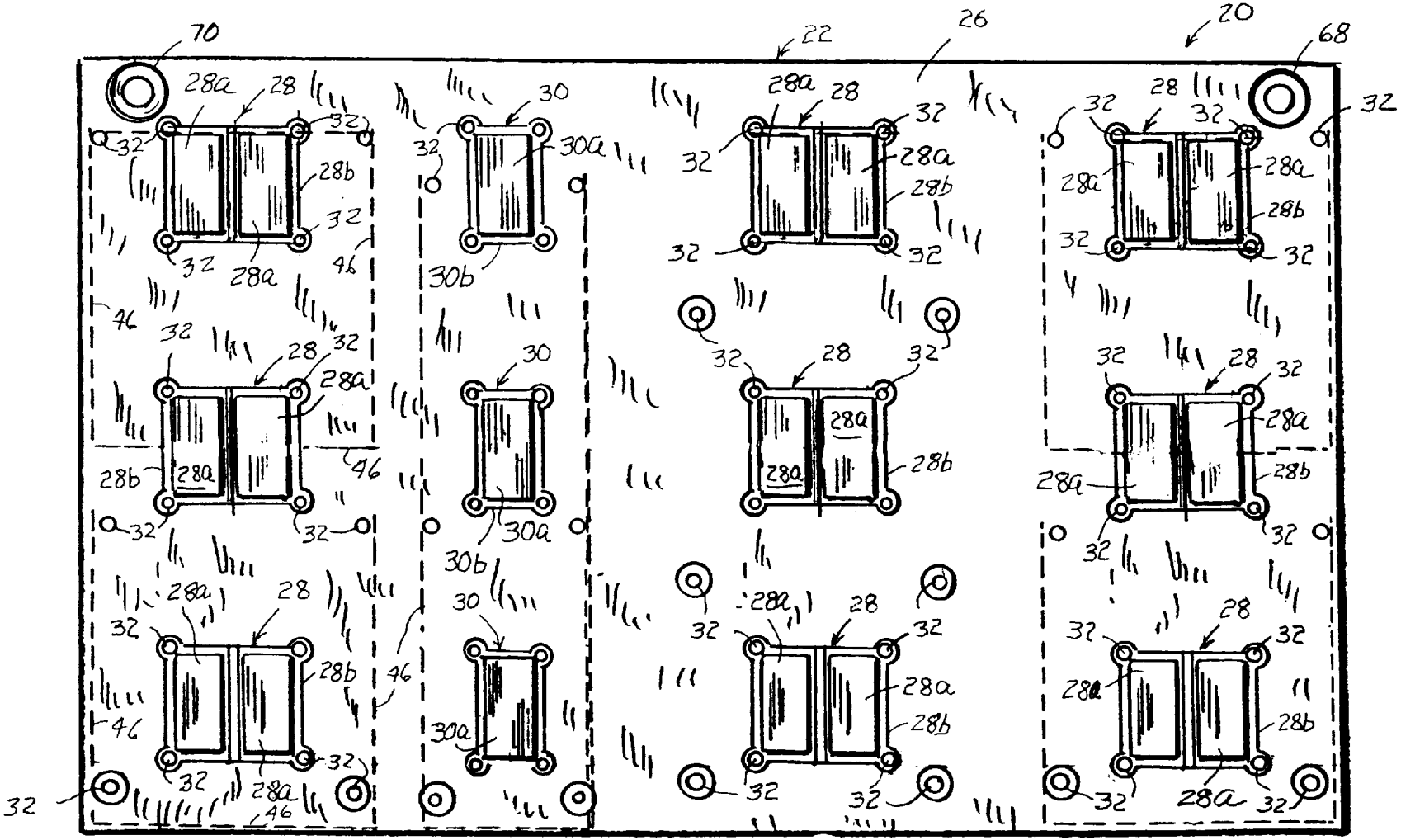
FIG. 2 is a rear elevational view of the outer surface of the first embodiment of the invention.

A plurality of magnet assemblies generally indicated by the numerals 28 and 30 are rigidly connected to the outer surface 26 of main body 22 as can be best seen in FIG. 2. Magnet assembly 28 contains two magnets 28*a* and 28*b* and magnet assembly 30 contains only one magnet 30*a*. If desired, magnet assembly 30 could be replaced with magnet assembly 28 for greater magnetic attraction. Furthermore, if desired magnet assembly 28 could be replaced with a magnet assembly containing three or more magnets for greater magnetic attraction.

Figure 7:
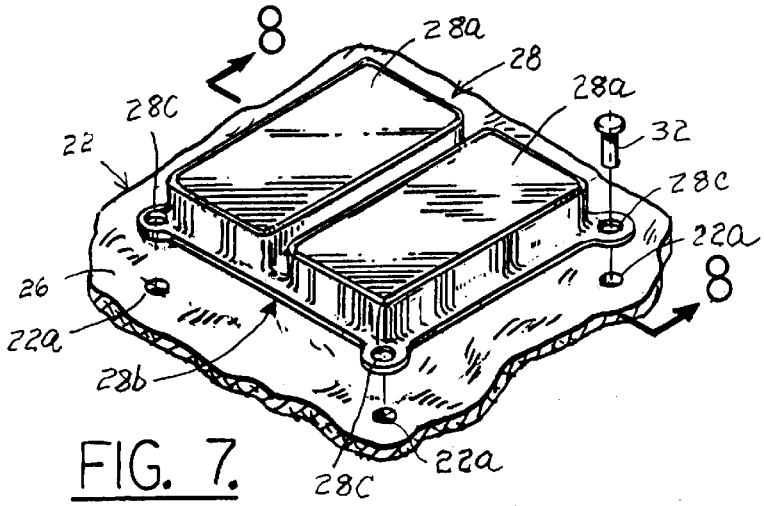
FIG. 7 is a perspective view of a magnet assembly of the invention.
Figure 8:
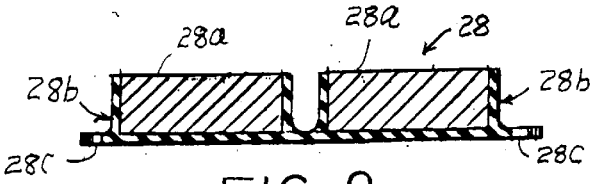
FIG. 8 is a cross-sectional view taken along lines 8—8 of FIG. 7.

As shown in FIGS. 7 and 8, magnet assembly 28 includes two magnets 28*a*–28*a*. Preferably, magnets 28*a*–28*a* are encased or enclosed in a polymeric lining generally indicated by the numeral 28*b*. Lining 28*b* holds magnets 28*a*–28*a* firmly therein for attachment of magnets 28*a*–28*a* to main body 22. Lining 28*b* has a plurality of circular openings 28*c* therein for receipt of rivets 32 in circular openings 22*a* for attachment of magnet assemblies 28 to main body 22.

Figure 9:
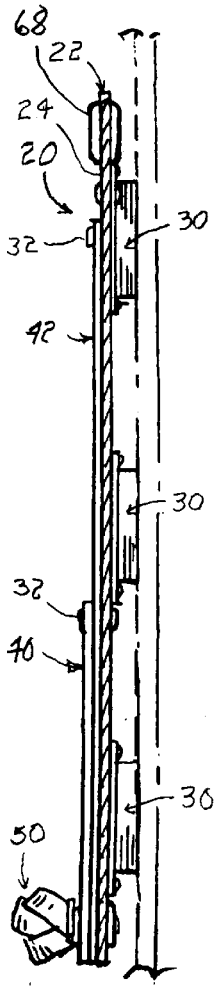
FIG. 9 is a cross-sectional view taken along lines 9—9 of FIG. 1 with a vertical metal surface shown in phantom lines.

As shown in FIGS. 2 and 9, magnet assembly 30 has one magnet 30*a*. Preferably, magnet 30*a* is encased or enclosed in a polymeric lining generally indicated by the numeral 30*b*. Lining 30*b* holds magnet 30*a* firmly therein for attachment of magnet 30*a* to main body 22. Lining 30*b* has a plurality of circular openings therein similar to circular openings 28*c* of lining 28*b* for receipt of rivets 32 for attachment of magnet assemblies 30 to main body 22.

Linings 28*b* and 30*b* and rivets 32 are preferred for attachment of magnets 28*a* and 30*a* to main body 22, but other methods known in the art for attachment of magnets may be utilized if desired.

Figure 6:
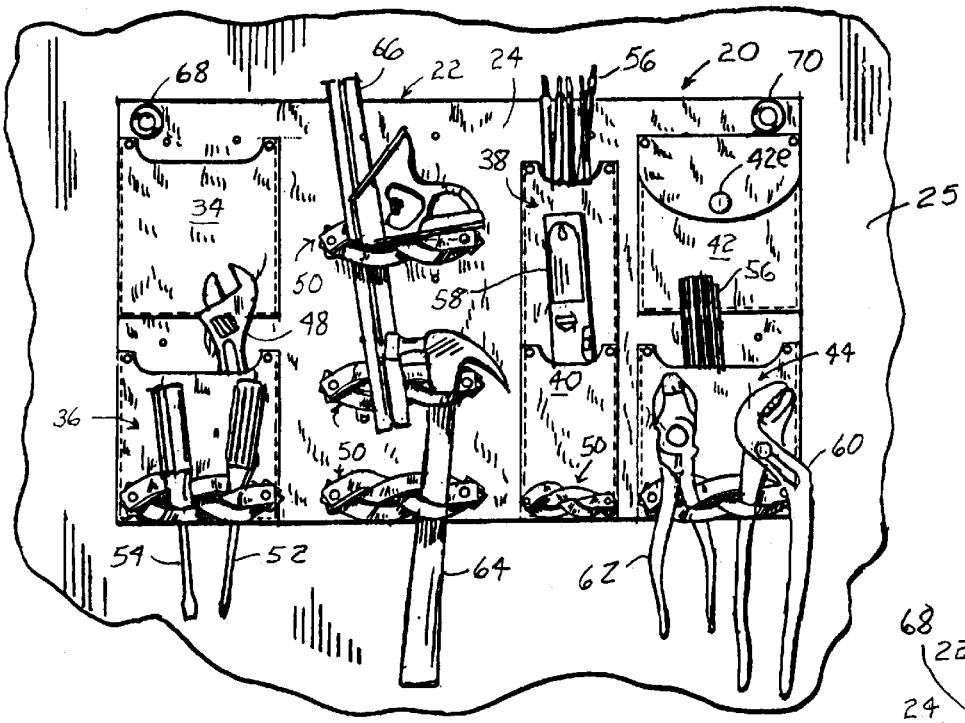
FIG. 6 is a front elevational view of the inner surface of the first embodiment of the invention connected to a metal wall with the tool holder having tools and equipment therein.

As can best be seen in FIGS. 1 and 6, the inner surface 24 of tool holder 22 contains a plurality of tool-holding pockets generally indicated by the numerals 34, 36,38,40,42, and 44, and a plurality of identical strap assemblies generally indicated by the numeral 50. Pocket 34 has two parallel side edges 34*a* and 34*b*, and a bottom edge 34*c*, all of which are preferably stitched to main body 22 by thread stitches 46 and at the top comers thereof by rivets 32—32. Pocket 34 has a curved upper edge 34*d* which forms the opening to the inside of pocket 34 for receipt of tools and equipment which the worker may desire to place in pocket 34.

Pocket 36 is identical to pocket 34 and has two parallel side edges 36*a* and 36*b*, and a bottom edge 36*c*, all of which are preferably stitched to main body 22 by thread stitches 46 and at the top corners thereof by rivets 32—32. Pocket 36 has a curved upper edge 36*d* which forms the opening to the inside of pocket 36 for receipt of tools and equipment which the worker may desire to place in pocket 36. In FIG. 6 pocket 36 can be seen to be holding a wrench 48 inserted therein while main body 22 is connected to a metal wall 25 by magnets 28*a* and 30*a*.

Pocket 36 also has a preferred strap assembly 50 connected thereto by rivets 32—32. Strap assembly 50 has three generally rectangular flat straps 50*a*, 50*b*, and 50*c* intertwined together and fastened at each of the ends thereof by rivet 32—32. As can be seen in FIG. 6, two screwdrivers 52 and 54 are inserted between the intertwined straps 50*a*, 50*b*, and 50*c*.

Pocket 38 is more narrow in width than pockets 34 and 36. Pocket 38 has two parallel side edges 38*a* and 38*b*, and a bottom edge 38*c* at the bottom edge of main body 22, all of which are preferably stitched to main body 22 by thread stitches 46 and at the top corners thereof by rivets 32—32. Pocket 38 has a curved upper edge 38*d* which forms the opening to the inside of pocket 38 for receipt of tools and equipment which the worker may desire to place in pocket 38. As can be seen in FIG. 6, welding rods 56 are shown to be inserted into pocket 38.

Pocket 40 is the same width as pocket 38. Pocket 40 has two parallel side edges 40*a* and 40*b*, and a bottom edge 38*c*, all of which are preferably stitched to main body 22 by thread stitches 46 and at the top corners thereof by rivets 32—32. Pocket 40 has a curved upper edge 40*d* which forms the opening to the inside of pocket 40 for receipt of tools and equipment which the worker may desire to place in pocket 40. As can be seen in FIG. 6, a tool 58 is shown to be inserted into pocket 40.

Pocket 40 also has a preferred strap assembly 50 connected thereto by rivets 32—32 which is slightly smaller in size than the remainder of the strap assemblies 50 of tool holder 20. Strap assembly 50 has three generally rectangular flat straps 50*a*, 50*b*, and 50*c* intertwined together and fastened at each of the ends thereof by rivet 3232.

Pocket 42 has two parallel side edges 42*a* and 42*b*, and a bottom edge 42*c*, all of which are preferably stitched to main body 22 by thread stitches 46 and at the top corners thereof by rivets 32—32. Pocket 42 has a flap 42*d* which covers the opening to the inside of pocket 42 for receipt of tools and equipment which the worker may desire to place in pocket 42. Flap 42*d* preferably has a snap closure 42*e* thereon.

Pocket 44 is identical to pocket 34 and has two parallel side edges 44*a* and 44*b*, and a bottom edge 44*c*, all of which are preferably stitched to main body 22 by thread stitches 46 and at the top corners thereof by rivets 32—32. Pocket 44 has a curved upper edge 44*d* which forms the opening to the inside of pocket 44 for receipt of tools and equipment which the worker may desire to place in pocket 44. As shown in FIG. 6, welding rods 56 are placed in pocket 44.

Pocket 44 also has a preferred strap assembly 50 connected thereto by rivets 32—32. Strap assembly 50 has three generally rectangular flat straps 50*a*, 50*b*, and 50*c* intertwined together and fastened at each of the ends thereof by rivet 32—32. As can be seen in FIG. 6, a pair of pliers 60 and a pair of wire cutters 62 are shown inserted between the intertwined straps 50*a*, 50*b*, and 50*c*.

Located between pockets 34 and 38 are three strap assemblies 50 as can be seen in FIGS. 1 and 6 which are vertically aligned on main body 22. Each of the strap assemblies 50 has three generally rectangular flat straps 50*a*, 50*b*, and 50*c* intertwined together and fastened at each of the ends thereof by rivet 32—32. As can be seen in FIG. 6, a hammer 64 is held between two adjacent strap assemblies 50, and a carpenter's square 66 is shown inserted between the intertwined straps 50*a*, 50*b*, and 50*c* of the top strap assembly.

Two metal eyelets 68 and 70 are preferably connected to each upper corner of main body 22. Eyelets 68 and 70 received snap hooks 72 and 74 connected to the belt assembly generally indicated by the numeral 76 in FIG. 5, 10 and 11. Belt assembly includes a belt 78 having snap hooks 72 and 74 connected thereto.

Figure 10:
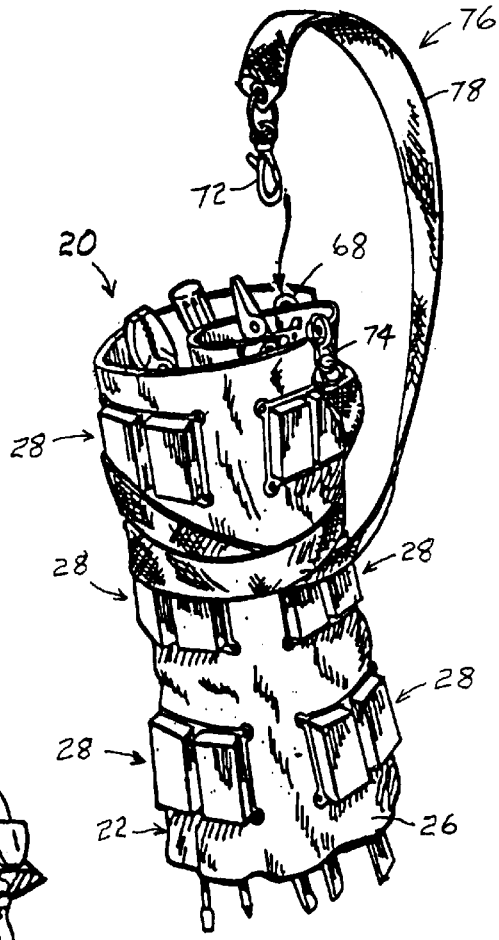
FIG. 10 is a perspective view of the tool holder of the first embodiment with the side edges folded around the inner surface and with the carrying strap shown in FIG. 5 wrapped therearound to secure tools and equipment therein and provide a loop for carrying over the shoulder of the worker.
Figure 11:
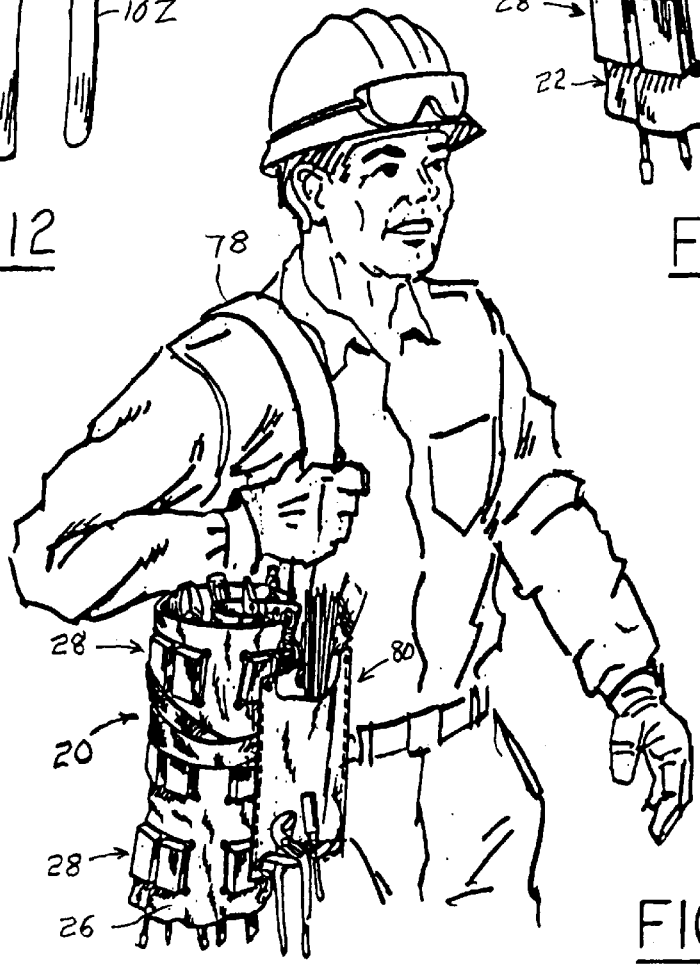
FIG. 11 is a perspective view of the tool holder of the first embodiment with the side edges folded around the inner surface, with the carrying strap shown in FIG. 5 wrapped therearound to secure tools and equipment therein, with the second embodiment of the tool holder of the invention connected to the first embodiment of the tool holder of the invention, and with a worker carrying both embodiments of the tool holders of the invention.

To transport the tool holder 20 of the invention, tools are placed in the tool holder 20 such as the tools and equipment shown in FIG. 6. the vertical edges of the main body 22 are wrapped around the tools on the inner face 24 as shown in FIG. 10. Belt assembly 76 is then wrapped around the outer surface 26 of main body 22 and one end is extended upward as shown in FIG. 10 to form a loop which fits over the shoulder of the worker as shown in FIG. 11 by connecting snap hook 72 to eyelet 68 shown in FIG. 11.

By wrapping the vertical tool holder edges around tools on the inner surface 24 of main body 22, and then wrapping belt assembly 76 around the outer surface 26 of main body 22, tools and equipment are secured tightly to tool holder 20 to prevent spillage of tools even when the tool holder 20 is inverted. Furthermore, belt assembly 76 provides a carrying strap 78 enabling a worker to carry a loaded tool holder 20 with both hands free for climbing.

Figure 3:
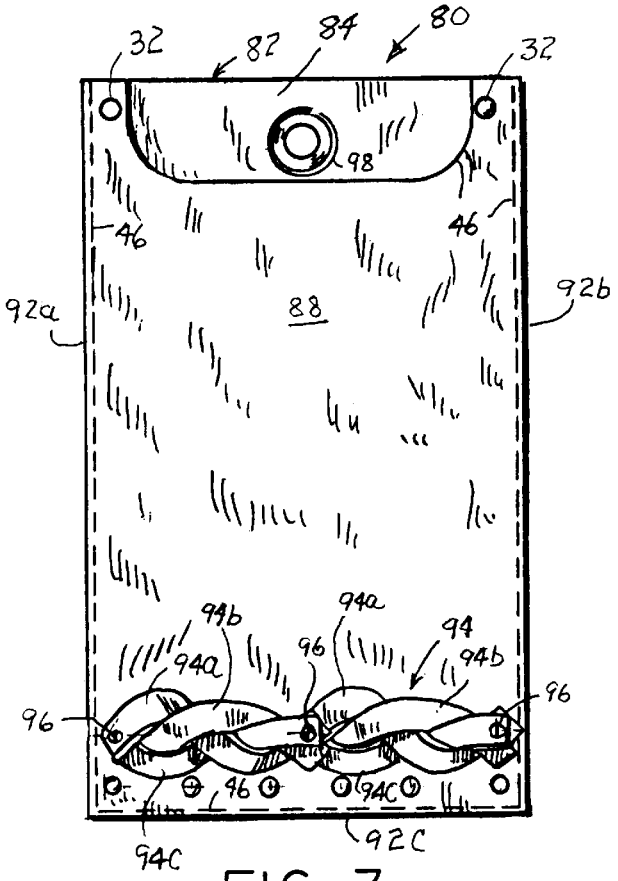
FIG. 3 is a front elevational view of the inner surface of the second embodiment of the invention.
Figure 4:
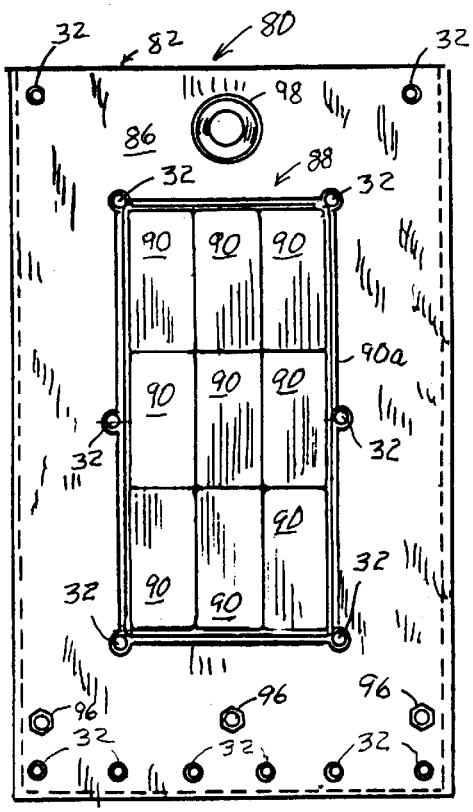
FIG. 4 is a rear elevational view of the outer surface of the second embodiment of the invention.
Figure 5:
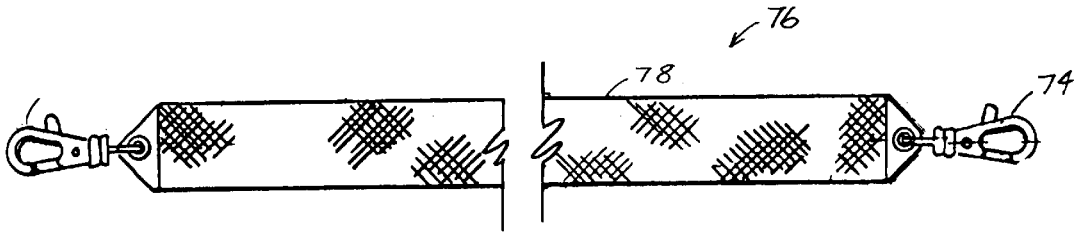
FIG. 5 is a plan view, partly cut-away of a carrying and wrapping strap for the tool holder of the first embodiment of the invention.
Figure 12:
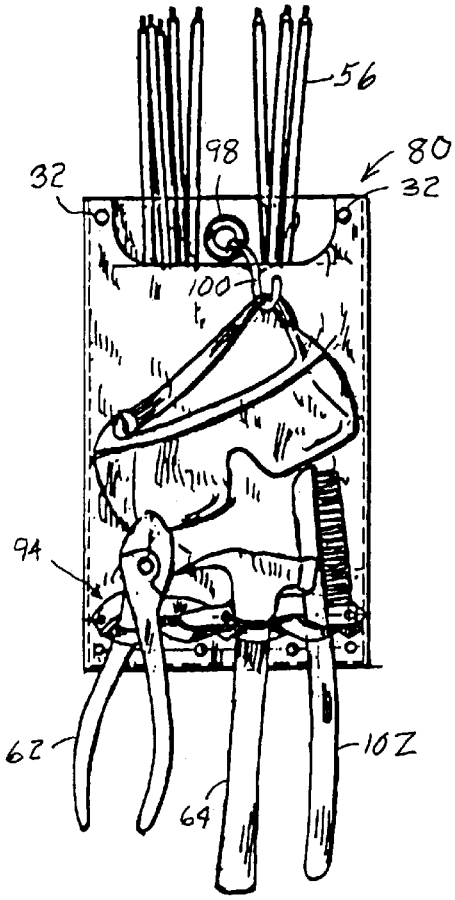
FIG. 12 is a front elevational view of the tool holder of the second embodiment of the invention.

In FIGS. 3, 4, and 12 is shown the second embodiment of the invention generally indicated by the numeral 80. Tool holder 80 has a main body generally indicated by the numeral 82. Preferably main body 82 is generally rectangular in shape. Main body 82 has an inner surface 84 and an outer surface 86. Preferably, main body 82 is made from a flexible leather such as cow hide, although other flexible materials such as heavy woven fabrics and the like could be used if desired.

A magnet assembly generally indicated by the numeral 88 is shown in FIG. 4 to be connected to the outer surface 86 of main body 82. Magnet assembly 88 contains nine magnets 90. Preferably, magnets 90 are encased or enclosed in a polymeric lining generally indicated by the numeral 90*a*. Lining 90*a* holds magnets 90—90 firmly therein for attachment of magnets 90—90 to main body 82. Lining 90*a* has a plurality of circular openings therein for receipt of rivets 32 for attachment of magnet assemblies 28 to main body 22.

Lining 90*a* and rivets 32 are preferred for attachment of magnets 90 to main body 82, but other methods known in the art for attachment of magnets may be utilized if desired.

As can best be seen in FIGS. 3 and 12, the inner surface 84 of tool holder 80 contains a single pocket generally indicated by the numeral 92, and a strap assembly generally indicated by the numeral 94 connected to the lower surface of pocket 92. Pocket 92 has two parallel side edges 92*a* and 92*b*, and a bottom edge 92*c*, all of which are preferably stitched to main body 22 by thread stitches 46 and at the top corners thereof by rivets 32—32. Pocket 92 has a curved upper edge 92*d* which forms the opening to the inside of pocket 92 for receipt of welding rods 56.

Pocket 92 also has a preferred strap assembly 94 connected thereto by nut and screw assemblies 96. Strap assembly 94 has two sets of three generally rectangular flat straps 94*a*, 94*b*, and 94*c* intertwined together and fastened at each of the ends thereof by nut and screw assemblies 96.

A metal eyelet 98 is preferably connected to the center of the upper edge of corner of main body 82. Eyelet 98 receives hooks 100 shown in FIG. 12 connected to goggles 102 or connected to tool holder 20 as shown in FIG. 11. Wire cutters 62, hammer 64, and wire brush 102 can be connected to strap assembly 94 as shown in FIG. 12.

Although the preferred embodiments of the invention have been described in detail above, it should be understood that the invention is in no sense limited thereby, and its scope is to be determined by that of the following claims:

What is claimed is:

1. A portable, flexible tool holder comprising:

a. a generally rectangular flexible main body, said main body having i. an inner surface ii. an outer surface iii. an upper edge, iv. a lower edge, and v. two side edges, vi. a plurality of magnets connected to said outer surface, and vii. a plurality of pockets and strap assemblies connected to said inner surface for holding tools and equipment, either of said edges being foldable toward the other of the side edges to enclose said inner surface inside said outer surface to tightly hold tools and equipment in said pockets and said strap assemblies within said tool holder, and said upper edge having receivers for attaching a carrying and wrapping device to said tool holder.

2. The tool holder of claim 1 wherein said carrying and wrapping device comprises a belt assembly.

3. The tool holder of claim 2 wherein said belt assembly includes an elongated strap having two snap hooks connected at each end thereof for connection to said receivers.

4. The tool holder of claim 3 wherein said strap assembly comprises three intertwined elongated straps for holding tools and equipment.

5. A portable tool holder comprising a generally rectangular body, said main body having an inner surface and an outer surface, said outer surface having a plurality of magnets connected thereto, said inner surface having a pocket for holding welding rods and a strap assembly located beneath on the lower end of the pocket for holding tools and equipment, and said body having a receiver for attaching a carrying device to the tool holder.

* * * * *